US009061403B2

(12) United States Patent
Colombo et al.

(10) Patent No.: US 9,061,403 B2
(45) Date of Patent: Jun. 23, 2015

(54) ELASTIC TUBE ALIGNMENT SYSTEM FOR PRECISELY LOCATING AN EMBLEM LENS TO AN OUTER BEZEL

(75) Inventors: Joel Colombo, Howell, MI (US); Steven E. Morris, Fair Haven, MI (US); Michael D. Richardson, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 478 days.

(21) Appl. No.: 13/571,030

(22) Filed: Aug. 9, 2012

(65) Prior Publication Data

US 2013/0019454 A1 Jan. 24, 2013

Related U.S. Application Data

(63) Continuation-in-part of application No. 13/187,675, filed on Jul. 21, 2011, now Pat. No. 8,695,201.

(51) Int. Cl.

| | |
|---|---|
| ***B21J 15/02*** | (2006.01) |
| ***B25B 27/00*** | (2006.01) |
| ***B25B 27/14*** | (2006.01) |

(52) U.S. Cl.

CPC ..... *B25B 27/00* (2013.01); *Y10T 29/53991* (2015.01); *Y10T 29/49895* (2015.01); *B25B 27/14* (2013.01)

(58) Field of Classification Search

USPC ..... 16/2.1; 24/456, 297, 453, 289; 29/450, 29/525.05, 897–897.35; 256/66; 411/179, 411/182, 508, 510, 509, 908

See application file for complete search history.

(56) References Cited

U.S. PATENT DOCUMENTS

| | | | |
|---|---|---|---|
| 1,301,302 | A | 4/1919 | Nolan |
| 1,819,126 | A | 8/1931 | Scheibe |
| 1,982,076 | A | 11/1934 | Spahn |
| 2,778,399 | A | 1/1957 | Mroz |
| 2,780,128 | A | 2/1957 | Rapata |
| 2,862,040 | A | 11/1958 | Curran |
| 2,902,902 | A | 9/1959 | Slone |
| 3,005,282 | A | 10/1961 | Christiansen |
| 3,014,563 | A | 12/1961 | Bratton |

(Continued)

FOREIGN PATENT DOCUMENTS

| | | | |
|---|---|---|---|
| CN | 1129162 | A | 8/1996 |
| CN | 2888807 | Y | 4/2007 |

(Continued)

OTHER PUBLICATIONS

U.S. Appl. No. 13/187,675, filed Jul. 21, 2011, titled "Elastic Tube Alignment System for Precisely Locating Components"—Inventor: Steven E. Morris.

(Continued)

*Primary Examiner* — Richard Chang
(74) *Attorney, Agent, or Firm* — Cantor Colburn LLP

(57) ABSTRACT

An elastic tube alignment system for the mating an emblem lens to an outer bezel utilizing the principle of elastic averaging. A plurality of geometrically separated elastic tube (male) alignment features are disposed on a first side of the emblem lens, while a plurality of one-to-one corresponding aperture (female) alignment features are provided in the outer bezel. During the mating, each elastic tube and its respective aperture provide elastic deformation, which, on average, precisely aligns the emblem lens with respect to the outer bezel.

17 Claims, 4 Drawing Sheets

(56) References Cited

U.S. PATENT DOCUMENTS

| | | | |
|---|---|---|---|
| 3,168,961 | A | 2/1965 | Yates |
| 3,194,292 | A | 7/1965 | Borowsky |
| 3,213,189 | A | 10/1965 | Mitchell et al. |
| 3,233,358 | A | 2/1966 | Dehm |
| 3,233,503 | A | 2/1966 | Birger |
| 3,244,057 | A | 4/1966 | Mathison |
| 3,531,850 | A | 10/1970 | Durand |
| 3,643,968 | A | 2/1972 | Horvath |
| 3,842,565 | A | 10/1974 | Brown et al. |
| 3,895,408 | A | 7/1975 | Leingang |
| 4,158,511 | A | 6/1979 | Herbenar |
| 4,213,675 | A | 7/1980 | Pilhall |
| 4,394,853 | A | 7/1983 | Lopez-Crevillen et al. |
| 4,406,033 | A | 9/1983 | Chisholm et al. |
| 4,805,272 | A | 2/1989 | Yamaguchi |
| 5,139,285 | A | 8/1992 | Lasinski |
| 5,234,122 | A | 8/1993 | Cherng |
| 5,397,206 | A | 3/1995 | Sihon |
| 5,507,610 | A | 4/1996 | Benedetti et al. |
| 5,513,603 | A | 5/1996 | Ang et al. |
| 5,524,786 | A | 6/1996 | Skudlarek |
| 5,538,079 | A | 7/1996 | Pawlick |
| 5,577,301 | A | 11/1996 | De Maagd |
| 5,577,779 | A | 11/1996 | Dangel |
| 5,580,204 | A | 12/1996 | Hultman |
| 5,634,757 | A | 6/1997 | Schanz |
| 5,736,221 | A | 4/1998 | Hardigg et al. |
| 5,806,915 | A | 9/1998 | Takabatake |
| 5,941,673 | A | 8/1999 | Hayakawa et al. |
| 6,193,430 | B1 | 2/2001 | Culpepper et al. |
| 6,209,178 | B1 | 4/2001 | Wiese et al. |
| 6,354,815 | B1 | 3/2002 | Svihla et al. |
| 6,378,931 | B1 | 4/2002 | Kolluri et al. |
| 6,398,449 | B1 | 6/2002 | Loh |
| 6,484,370 | B2 | 11/2002 | Kanie et al. |
| 6,485,241 | B1 | 11/2002 | Oxford |
| 6,591,801 | B1 | 7/2003 | Fonville |
| 6,609,717 | B2 | 8/2003 | Hinson |
| 6,840,969 | B2 | 1/2005 | Kobayashi et al. |
| 6,857,676 | B2 | 2/2005 | Kawaguchi et al. |
| 6,932,416 | B2 | 8/2005 | Clauson |
| 6,948,753 | B2 | 9/2005 | Yoshida et al. |
| 6,959,954 | B2 | 11/2005 | Brandt et al. |
| 6,971,831 | B2 | 12/2005 | Fattori et al. |
| 7,008,003 | B1 | 3/2006 | Hirose et al. |
| 7,036,779 | B2 | 5/2006 | Kawaguchi et al. |
| 7,089,998 | B2 | 8/2006 | Crook |
| 7,178,855 | B2 | 2/2007 | Catron et al. |
| 7,306,418 | B2 | 12/2007 | Kornblum |
| 7,322,500 | B2 | 1/2008 | Maierholzner |
| 7,344,056 | B2 | 3/2008 | Shelmon et al. |
| D602,349 | S | 10/2009 | Andersson |
| 7,764,853 | B2 | 7/2010 | Yi et al. |
| 7,793,998 | B2 | 9/2010 | Matsui et al. |
| 7,802,831 | B2 | 9/2010 | Isayama et al. |
| 7,828,372 | B2 | 11/2010 | Ellison |
| 7,883,137 | B2 | 2/2011 | Bar |
| 8,136,819 | B2 | 3/2012 | Yoshitsune et al. |
| 8,162,375 | B2 | 4/2012 | Gurtatowski et al. |
| 8,261,581 | B2 | 9/2012 | Cerruti et al. |
| 8,297,137 | B2 | 10/2012 | Dole |
| 8,444,199 | B2 | 5/2013 | Takeuchi et al. |
| 8,695,201 | B2 | 4/2014 | Morris |
| 2002/0045086 | A1 | 4/2002 | Tsuji et al. |
| 2002/0092598 | A1 | 7/2002 | Jones et al. |
| 2002/0136617 | A1 | 9/2002 | Imahigashi |
| 2003/0082986 | A1 | 5/2003 | Wiens et al. |
| 2003/0108401 | A1 | 6/2003 | Agha et al. |
| 2003/0180122 | A1 | 9/2003 | Dobson |
| 2004/0139678 | A1 | 7/2004 | Pervan |
| 2005/0031946 | A1 | 2/2005 | Kruger et al. |
| 2005/0244250 | A1 | 11/2005 | Okada et al. |
| 2006/0102214 | A1 | 5/2006 | Clemons |
| 2006/0141318 | A1 | 6/2006 | MacKinnon et al. |
| 2007/0292205 | A1 | 12/2007 | Duval |
| 2009/0134652 | A1 | 5/2009 | Araki |
| 2009/0174207 | A1 | 7/2009 | Lota |
| 2010/0021267 | A1 | 1/2010 | Nitsche |
| 2010/0270745 | A1 | 10/2010 | Hurlbert et al. |
| 2011/0076588 | A1 | 3/2011 | Yamaura |
| 2011/0296764 | A1 | 12/2011 | Sawatani et al. |
| 2012/0115010 | A1 | 5/2012 | Smith et al. |
| 2013/0019454 | A1 | 1/2013 | Colombo et al. |
| 2013/0019455 | A1 | 1/2013 | Morris |
| 2013/0157015 | A1 | 6/2013 | Morris |
| 2013/0287992 | A1 | 10/2013 | Morris |
| 2014/0033493 | A1 | 2/2014 | Morris et al. |
| 2014/0041176 | A1 | 2/2014 | Morris |
| 2014/0157578 | A1 | 6/2014 | Morris et al. |
| 2014/0159412 | A1 | 6/2014 | Morris et al. |
| 2014/0208561 | A1 | 7/2014 | Colombo et al. |
| 2014/0208572 | A1 | 7/2014 | Colombo et al. |
| 2014/0220267 | A1 | 8/2014 | Morris et al. |
| 2014/0292013 | A1 | 10/2014 | Colombo et al. |
| 2014/0298638 | A1 | 10/2014 | Colombo et al. |
| 2014/0298640 | A1 | 10/2014 | Morris et al. |
| 2014/0298962 | A1 | 10/2014 | Morris et al. |
| 2015/0016918 | A1 | 1/2015 | Colombo |

FOREIGN PATENT DOCUMENTS

| | | | |
|---|---|---|---|
| CN | 2915389 | Y | 6/2007 |
| CN | 101250964 | A | 4/2008 |
| CN | 201268336 | Y | 7/2009 |
| CN | 201703439 | U | 1/2011 |
| CN | 201737062 | U | 2/2011 |
| CN | 201792722 | U | 4/2011 |
| CN | 202079532 | U | 12/2011 |
| DE | 3711696 | A1 | 10/1988 |
| DE | 69600357 | T2 | 12/1998 |
| DE | 10234253 | B3 | 4/2004 |
| DE | 102008005618 | A1 | 7/2009 |
| DE | 102010028323 | A1 | 11/2011 |
| DE | 102011050003 | A1 | 10/2012 |
| EP | 0118796 | | 9/1984 |
| EP | 1132263 | A1 | 9/2001 |
| EP | 1293384 | A2 | 3/2003 |
| EP | 2450259 | A1 | 5/2012 |
| JP | 2001171554 | A | 6/2001 |
| JP | 2005268004 | | 9/2005 |
| JP | 2006205918 | | 8/2006 |
| JP | 2009084844 | | 4/2009 |
| WO | 2008140659 | A1 | 11/2008 |

OTHER PUBLICATIONS

U.S. Appl. No. 13/229,926, filed Sep. 12, 2011, titled "Using Elastic Averaging for Alignment of Battery Stack, Fuel Cell Stack, or Other Vehicle Assembly"—Inventors: MArk A. Smith, Ronald Daul, Xiang Zhao, David Okonski, Elmer Santos, Lane Lindstrom and Jeffrey A. Abell.

U.S. Appl. No. 13/330,718, filed Dec. 20, 2011, titled "Precisely Locating Components in an Infrared Welded Assembly"—Inventor: Steven E. Morris.

U.S. Appl. No. 13/459,118, filed Apr. 28, 2012, titled "Stiffened Multi-layer Compartment Door Assembly Utilizing Elastic Averaging"—Inventor: Steven E. Morris.

U.S. Appl. No. 13/567,580, filed Aug. 6, 2011, titled "Semi-Circular Alignment Features of an Elastic Averaging Alignment System"—Inventors: Steven E. Morris and Thomas F. Bowles.

U.S. Appl. No. 13/570,959, filed Aug. 9, 2012, titled "Elastic Cantilever Beam Alignment System for Precisely Aligning Components"—Inventor: Steven E. Morris.

Awtar, S. & Sevincer, E. (Sep. 2006). Elastic Averaging in Flexure Mechanisms: A Multi-Beam Parallelogram Flexure Case-Study. From the Proceedings of IDETC/CIE 2006, Paper DETC2006-99752, American Society of Mechanical Engineers (ASME).

Balasubramaniam, M., Golaski, E., Son, S., Sriram, K. & Slocum, A. (Jul. 2002). An Anti Backlash Two-Part Shaft Coupling with Interlocking Elastically Averaged Teeth. Precision Engineering, vol. 26, No. 3, Elsevier Publishing.

(56) References Cited

OTHER PUBLICATIONS

DeVita, L., Plante, J. & Dubowsky, S. (Jun. 2007). The Design of High Precision Parallel Mechanisms using Binary Actuation and Elastic Averaging: With Application to MRI Cancer Treatment., 12th IFToMM World Congress, Besancon (France).

Gurung, S. (Dec. 2007). Passive Alignment of Micro-Fluidic Chips Using the Principle of Elastic Averaging. Thesis: Louisiana State University, Dept. of Mechanical Engineering.

Willoughby, P. & Slocum, A. (2004). Precision Connector Assembly using Elastic Averaging. Massachusetts Institute of Technology (MIT), Cambridge, MA, American Society for Precision Engineering.

Chinese Office Action for Application No. 201210255136.8; Issued Mar. 26, 2014.

"Coupling Types—Elastic Averaging." MIT. Aug. 3, 2012, [online], [retrieved on Nov. 12, 2014]. Retrieved from the Internet <URL:https://web.archive.org/web/20120308055935/http://pergatory.mit.edu/kinematiccouplings/html/about/ elastic_averaging.html>.

Cross-sectional view of a prior art infrared welded assembly of BMW, Munich, Germany. Believed on the market since about Jan. 1, 2010.

U.S. Appl. No. 14/259,747, filed Apr. 23, 2014, entitled "System for Elastically Averaging Assembly of Components," inventors: Steven E Morris and Jennifer P. Lawall.

U.S. Appl. No. 14/134,622, filed Dec. 19, 2013, entitled "Elastic Averaging Alignment Member," inventors: Steven E. Morris and Jennifer P. Lawall.

U.S. Appl. No. 14/134,844, filed Dec. 19, 2013, entitled "Elastically Deformable Module Installation Assembly," inventors: Steven E. Morris, Jennifer P. Lawall and Paul B. Stambaugh.

U.S. Appl. No. 14/151,279, filed Jan. 9, 2014, entitled "Elastically Averaged Alignment Systems and Methods," inventors: Steven E. Morris and Jennifer P. Lawall.

U.S. Appl. No. 14/231,395, filed Mar. 31, 2014, entitled "Elastically Averaged Alignment Systems and Methods," inventors: Joel Colombo, Steven E. Morris, Jennifer Pl Lawall, and Ashish M. Collapalli.

U.S. Appl. No. 14/249,746, filed Apr. 10, 2014, entitled "Elastically Averaged Alignment Systems and Methods," inventors: Joel Colombo and Catherine A. Ostrander.

ELASTIC TUBE ALIGNMENT SYSTEM FOR PRECISELY LOCATING AN EMBLEM LENS TO AN OUTER BEZEL

CROSS-REFERENCE TO RELATED APPLICATIONS

The present patent application is a Continuation-in-Part patent application of U.S. patent application Ser. No. 13/187,675, filed on Jul. 21, 2011, which is presently pending.

TECHNICAL FIELD

The present invention relates to location features for aligning of components during a mating operation. More particularly, the present invention relates to a plurality of mutually spaced apart elastic tube alignment features of an emblem lens which elastically deform on average when mated to receiving aperture alignment features of an outer bezel to thereby precisely align the first and second components during a mating operation.

BACKGROUND OF THE INVENTION

Currently, components which are to be mated together in a manufacturing process are mutually located with respect to each other by 2-way and/or 4-way male alignment features, typically upstanding bosses, which are received into corresponding female alignment features, typically apertures in the form of holes or slots. There is a clearance between the male alignment features and their respective female alignment features which is predetermined to match anticipated size and positional variation tolerances of the male and female alignment features as a result of manufacturing (or fabrication) variances. As a result, there can occur significant positional variation as between the mated first and second components which contributes to the presence of undesirably large and varying gaps and otherwise poor fit therebetween.

According to the prior art location modality for the aligning of an emblem lens to an outer bezel as they are being mutually mated, the emblem lens is located within a pocket of the outer bezel. The pocket sidewalls are configured to be oversized in relation to the perimeter of the emblem lens so that there is everywhere spacing therebetween. This clearance between the pocket sidewalls and the corresponding perimeter of the emblem lens is provided in order to accommodate manufacturing variation as between these two components as they are mated to one another. Problematically, this clearance between the emblem lens and the pocket allows positional variation as between the emblem lens and the outer bezel, and once the emblem lens is affixed to the outer bezel, as for example by two-sided tape or emblem adhesive, any misfit of alignment may render the fit unacceptable for a Class A finish.

Accordingly, what remains needed in the art is to somehow provide an alignment modality for the mating of components, in particular an emblem lens with respect to an outer bezel, wherein when mating is completed there is a lack of play therebetween and the alignment is precise.

SUMMARY OF THE INVENTION

The present invention is an elastic tube alignment system for the precise mating of two components, particularly an emblem lens with respect to an outer bezel, wherein when mating is completed there is a lack of float (or play) as between the male and female alignment features so as to provide a precision alignment with a stiffened positional constraint.

The elastic tube alignment system according to the present invention operates on the principle of elastic averaging as discussed in U.S. patent application Ser. No. 13/187,675, filed on Jul. 21, 2011, entitled Elastic Tube Alignment System for Precisely Locating Components, to Steven E. Morris and assigned to the assignee hereof, the entire disclosure of which is hereby incorporated herein by reference.

A plurality of geometrically separated elastic tube (male) alignment features are disposed on a first component, an emblem lens, while a plurality of one-to-one corresponding aperture (female) alignment features are provided on a second component, an outer bezel, wherein the elastic tube alignment features have a diameter exceeding a cross-section of the aperture alignment features. During the mating of the emblem lens to the outer bezel, each elastic tube alignment feature respectively engages its corresponding aperture alignment feature. As the elastic tube alignment features are received into the aperture alignment features, any manufacturing variance in terms of position and size of the elastic tube and aperture alignment features is accommodated by elastic deformation, on average, at the interface between the elastic tube and aperture alignment features. This elastic averaging across the plurality of elastic tube and aperture alignment features provides a precise alignment as between the emblem lens and the outer bezel when they are mated relative to each other, and yet the mating proceeds smoothly and easily.

In accordance with the present invention, the elastic averaging provides a precise alignment of the components within a variance X', defined by $X'=X/\sqrt{N}$, where X is the average manufacturing variance of the elastic tube alignment features and the aperture alignment features, and N is the number thereof. Thus, the needed clearance for the male and female alignment features of the prior art is obviated by the present invention.

According to the present invention, the elastic tube alignment features are elastically deformable by elastic compression of the tube wall of the elastic tube, which deformation is preferably resiliently reversible. In an exemplar application of the present invention, the elastic tube alignment features are connected (typically integrally) to the emblem lens at a first (or rear) side thereof in upstanding, perpendicular relation thereto (the first side has a Class B finish which is not meant to be visible, wherein the opposite, second (or front) side, is meant to be visible and has a Class A finish). Further according to the present invention, it is possible, but not required, for the aperture alignment members to be elastically deformable by elastic expansion of the aperture wall of the aperture, which deformation is preferably resiliently reversible. In an exemplar application of the present invention, the aperture alignment features are disposed in the outer bezel, typically as a slot or a hole therein, wherein the diameter of the elastic tube alignment features exceeds the cross-section of the aperture alignment features, and whereby elastic deformation occurs as each elastic tube alignment feature is received into its respective aperture alignment feature. The process of mating with precise alignment is both smoothly and easily performed. This is enhanced by a tapering (smaller diameter with increasing height) of the elastic tube alignment features so as to facilitate their initial entry into the aperture alignment features, and by beveling of the aperture wall of the aperture alignment features so as to locally pronounce the elastic deformation at the interface of the aperture wall with the tube wall.

In operation, as the emblem lens and the outer bezel are mated together, the initial contact therebetween is at the plurality of geometrically spaced apart elastic tube alignment members passing into their one-to-one corresponding aperture alignment features. Because of the larger size of the diameter of elastic tube alignment features relative to the cross-section of the aperture alignment features, an elastic deformation occurs at the interface therebetween, and this deformation is averaged over the geometrical distribution of the plurality of elastic tube alignment features. The alignment becomes precise when the emblem lens and the outer bezel have fully mated because the tapering of the elastic tube alignment features provides a largest diameter to the cross-section of the aperture alignment features when the first and second components have arrived at final mating. When an affixment modality is implemented, such as for example an emblem adhesive, the precise alignment becomes manifest, and the visible joint between the emblem lens and the outer bezel is a perfect Class A finish.

Accordingly, it is an object of the present invention to provide an elastic tube alignment modality for the mating of an emblem lens to an outer bezel, wherein when mating is completed there is a lack of play as between the elastic tube and aperture alignment features so as to thereby provide a precision alignment, yet the mating proceeds smoothly and effortlessly.

This and additional objects, features and advantages of the present invention will become clearer from the following specification of a preferred embodiment.

DESCRIPTION OF THE PREFERRED EMBODIMENT

Figure 1:
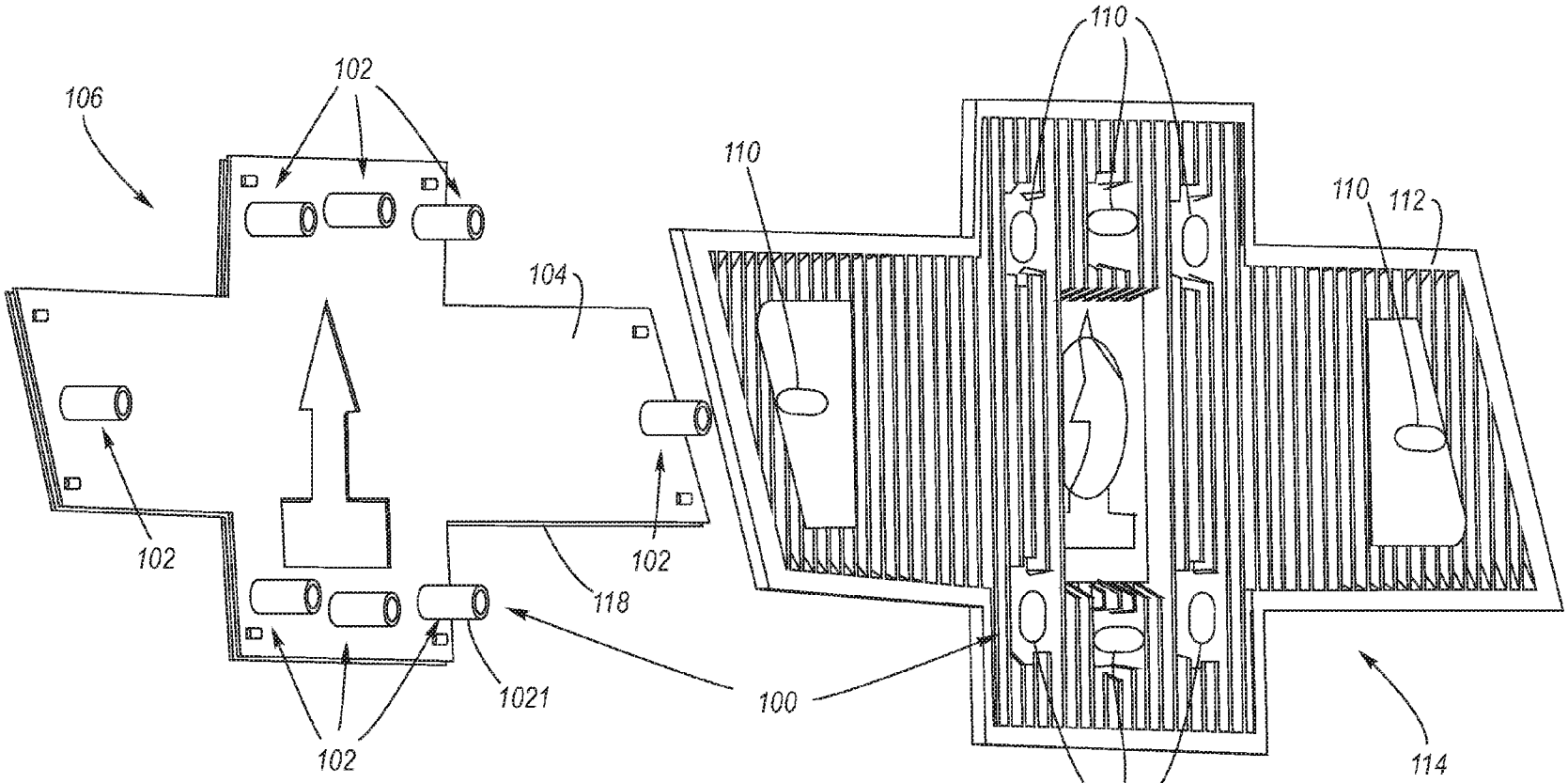
FIG. 1 is a perspective, exploded view of an emblem bezel having a plurality of elastic tube alignment features and an outer bezel having a plurality of aperture alignment features, wherein the emblem lens and the outer bezel are depicted just prior to mutual mating in accordance with the present invention.

Referring now to the Drawings, FIGS. 1 through 7 depict various aspects of the structure and function of the elastic tube alignment system 100 according to the present invention as it is applied to the mating of an emblem lens 106 with respect to an outer bezel 114, wherein the elastic tube alignment system operates on the principle of elastic averaging.

Figure 4:
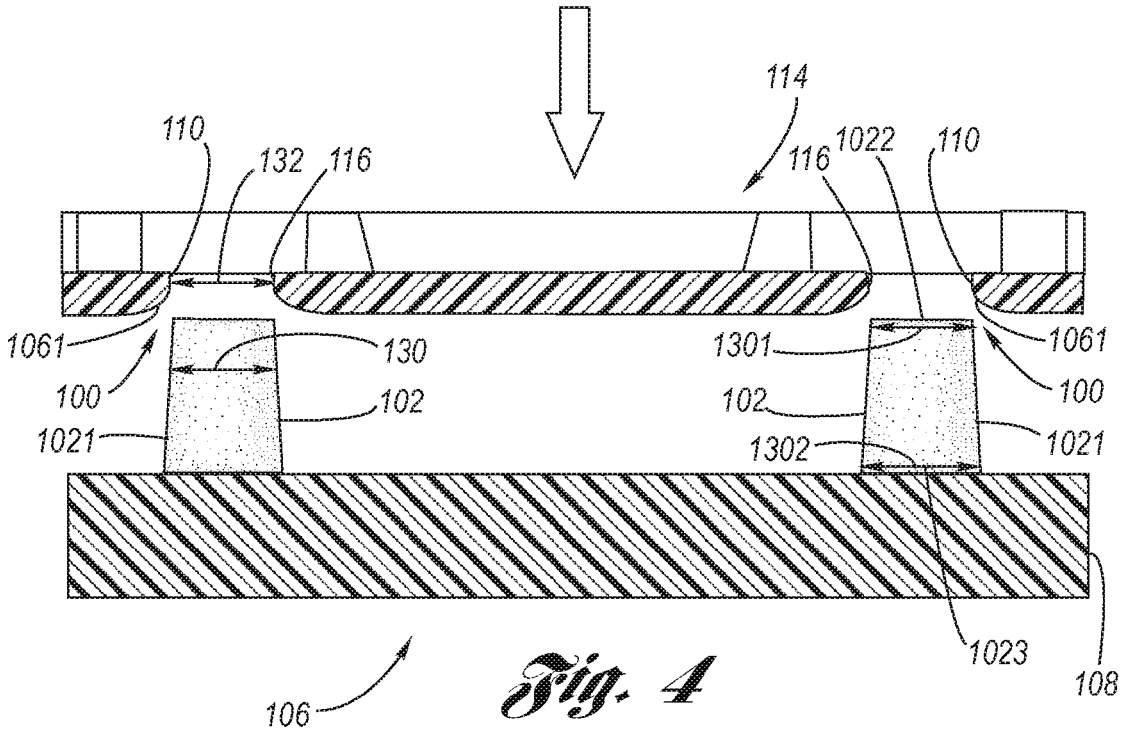
FIG. 4 is a sectional view as in FIG. 3, wherein now the emblem bezel having the plurality of elastic tube alignment features of FIG. 1 is about to be mated to the outer bezel having the plurality of aperture alignment features of FIG. 1 in accordance with the present invention.

A plurality of mutually separated elastic tube alignment features (serving as male alignment features) 102 (hereinafter referred to simply as "elastic tubes") are disposed on a first side 104 of the emblem lens, wherein, typically, the first side is a Class B finish side that is not intended to be visible (the opposite side has a Class A finish that is intended to be visible). As best shown at FIG. 4, the elastic tubes 102 are upstanding in normal relation to the first side 104, wherein a mutually separated pair of elastic tubes is shown disposed generally adjacent the perimeter 108. Each of the elastic tubes 102 is tubular in shape, having a tube wall 1021. Preferably, the tube wall 1021 defines a hollow cylinder. The tube wall 1021 is elastic, being preferably stiffly elastic, wherein the shape is resiliently reversible in response to a compressive force being applied thereto. A preferred plastic material is one having elastic properties so as to deform without fracture, as for a nonlimiting example acrylonitrile butadiene styrene (ABS).

Figure 7:
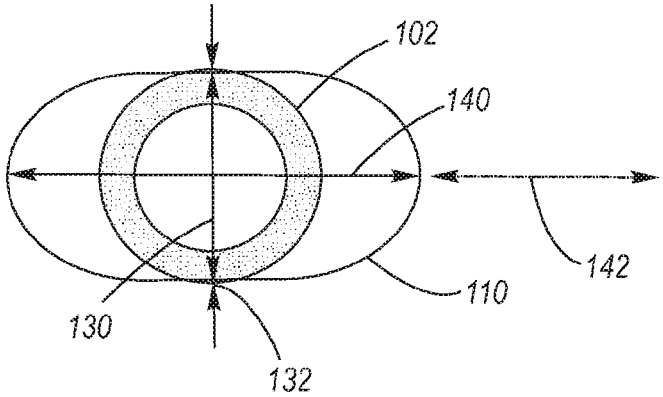
FIG. 7 is a detail view, seen at circle 7 of FIG. 6.

A plurality of aperture alignment features (serving as female alignment features) 110 (hereinafter referred to simply as "apertures") are disposed in a first side 112 of the outer bezel 114, being located in one-to-one correspondence with the plurality of elastic tubes 102; that is, for each elastic tube is a respective aperture into which it is receivable. Thus, the plurality of apertures are geometrically distributed in coordinated relationship to a geometrical distribution of the plurality of elastic tubes such that each elastic tube is receivable into its respect aperture. As best shown at FIG. 7, the apertures 110 have an aperture elongation 140 parallel to an elongation axis 142 and an aperture cross-section 132 which is oriented perpendicular to the elongation axis, wherein the aperture elongation is longer than the aperture cross-section for purposes of alignment which will be discussed in detail hereinbelow. An aperture wall 116 defines the perimeter of the apertures 110, and preferably is beveled 1161 (see FIG. 4), the purpose of which will be discussed hereinbelow. A preferred plastic material for the second component 114 in which the apertures 110 are disposed is one having elastic properties so as to deform without fracture, as for a nonlimiting example acrylonitrile butadiene styrene (ABS). While it is preferred for the emblem lens and the outer bezel 106, 114 to be motor vehicle components, this is not a requirement.

Figure 2:
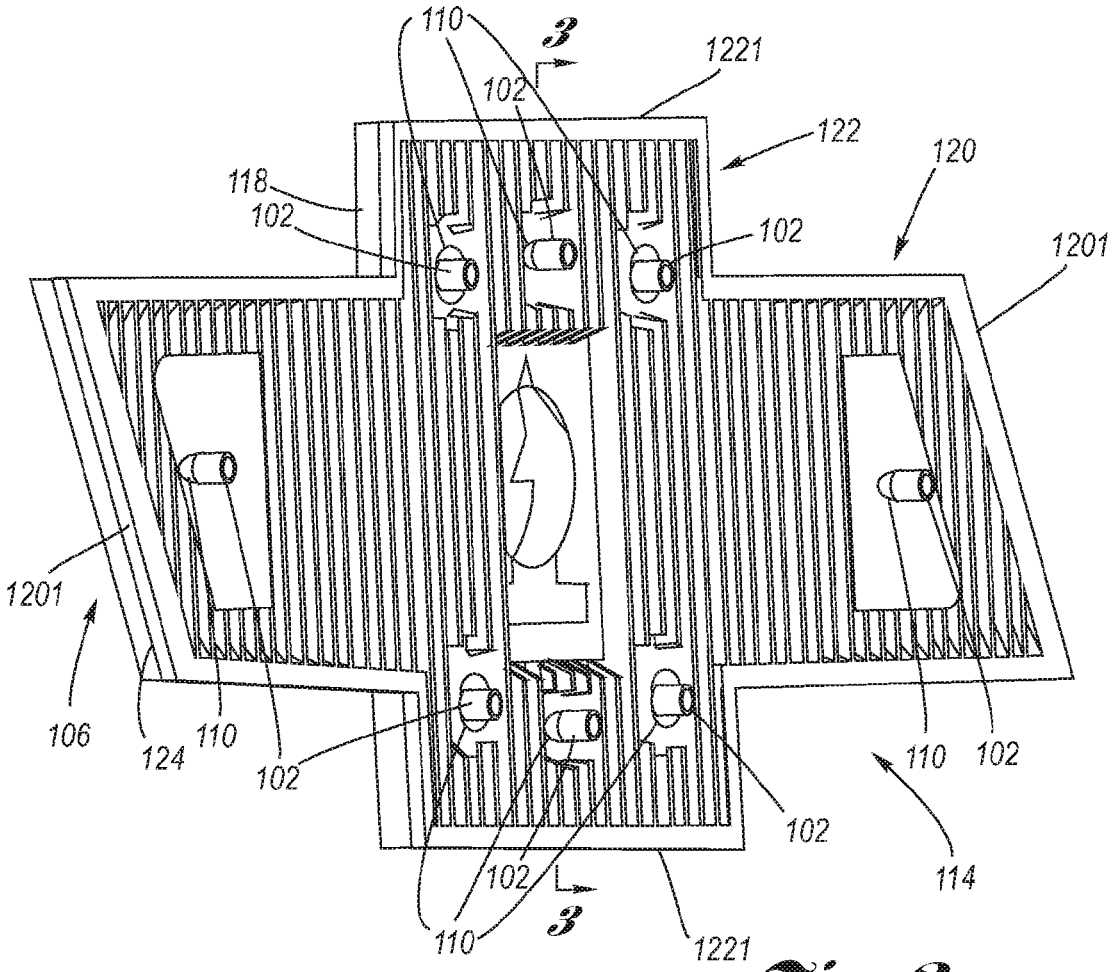
FIG. 2 is a perspective view of the emblem lens and the outer bezel of FIG. 1, now shown in a fully mated state thereof.

As generally depicted at FIGS. 1 and 2, the geometrical distribution of the elastic tubes 102 at the first side 104 of the emblem lens 106 (and, as a consequence, the distribution of the apertures 110 at the first side 112 of the outer bezel 114) is predetermined in relation to the shape of the perimeter 118 of the emblem lens. For example in the depiction of FIG. 2, an emblem lens has a "bowtie" shape defined by the perpendicular crossing of an elongated horizontal quadrangle 120 with a truncated vertical rectangle 122, it is preferred to place three elastic tubes 102 adjacent each end 1221 of the truncated vertical rectangle, wherein the centermost elastic tubes are mutually more separated than are the elastic tubes on either side thereof, and place one elastic tube 102 bisectionally at adjacent each end 1201 of the elongated horizontal quadrangle 120; the outer bezel has a one-to-one corresponding distribution of the apertures 110 to the elastic tubes 102. In accordance with the foregoing teaching, other geometrical distributions for other shapes of perimeters can be provided by an artisan.

Figure 3:
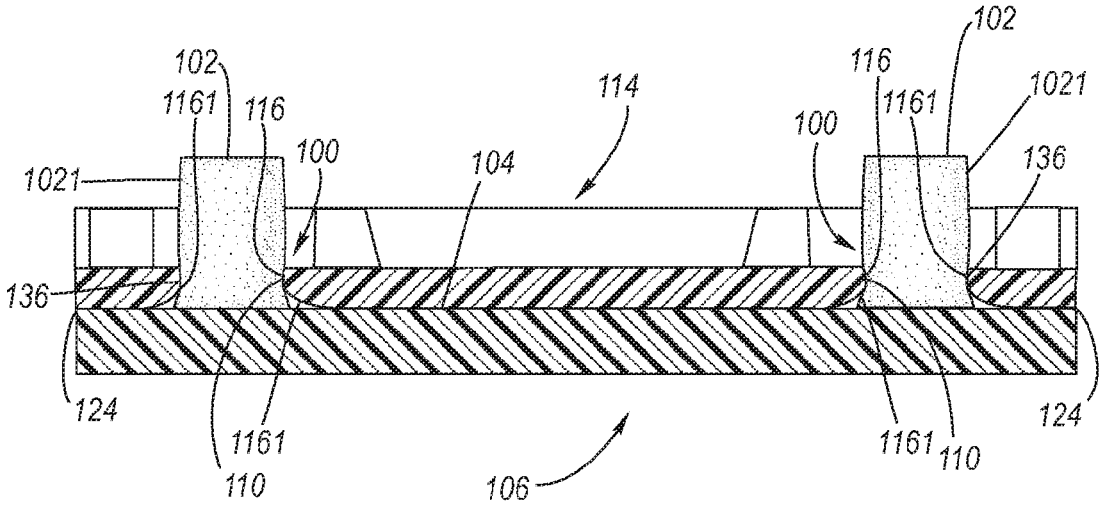
FIG. 3 is a cross-sectional view, seen along line 3-3 in FIG. 2.

As depicted at FIG. 4, the tube diameter 130 of the elastic tubes 102 exceeds the aperture cross-section 132 of the apertures 110, whereby elastic deformation proceeds as each elastic tube is received into its respective aperture. As shown at FIG. 3, the elastic deformation of the tube wall 1021 is locally pronounced due to the beveling 1161 of the aperture wall 116, wherein there is provided a relatively small contact area as between the aperture wall contact surface 1162 and the tube wall 1021 is spaced from the first side 104 of the emblem lens which facilitates resilient response absent influence of the first side. Since the compressive force between the aperture wall and the tube wall is limited to the smaller surface area of the aperture wall contact surface 1162, a higher compressive pressure is provided, see for example the elastic deformation 136 shown at FIGS. 2 and 5.

The process of mating the emblem lens 106 to the outer bezel 114 is both smoothly and easily performed, facilitated by a tapering (smaller diameter with increasing height, as shown comparatively at FIG. 4 by distal and proximal diameters 1301 and 1302 of the distal and proximal ends 1022, 1023 of the tube diameter 130 of the tube wall 1021. In this regard, the tapering of the elastic tubes presents a largest diameter 1302 at the cross-section of the apertures when the emblem lens and the outer bezel have arrived at final mating, i.e., the fully mated state; further, the tapering may present a smallest diameter 1301 of the tube wall at the distal end 1022 so as to ease initial entry of the elastic tubes into the apertures.

Figure 6:
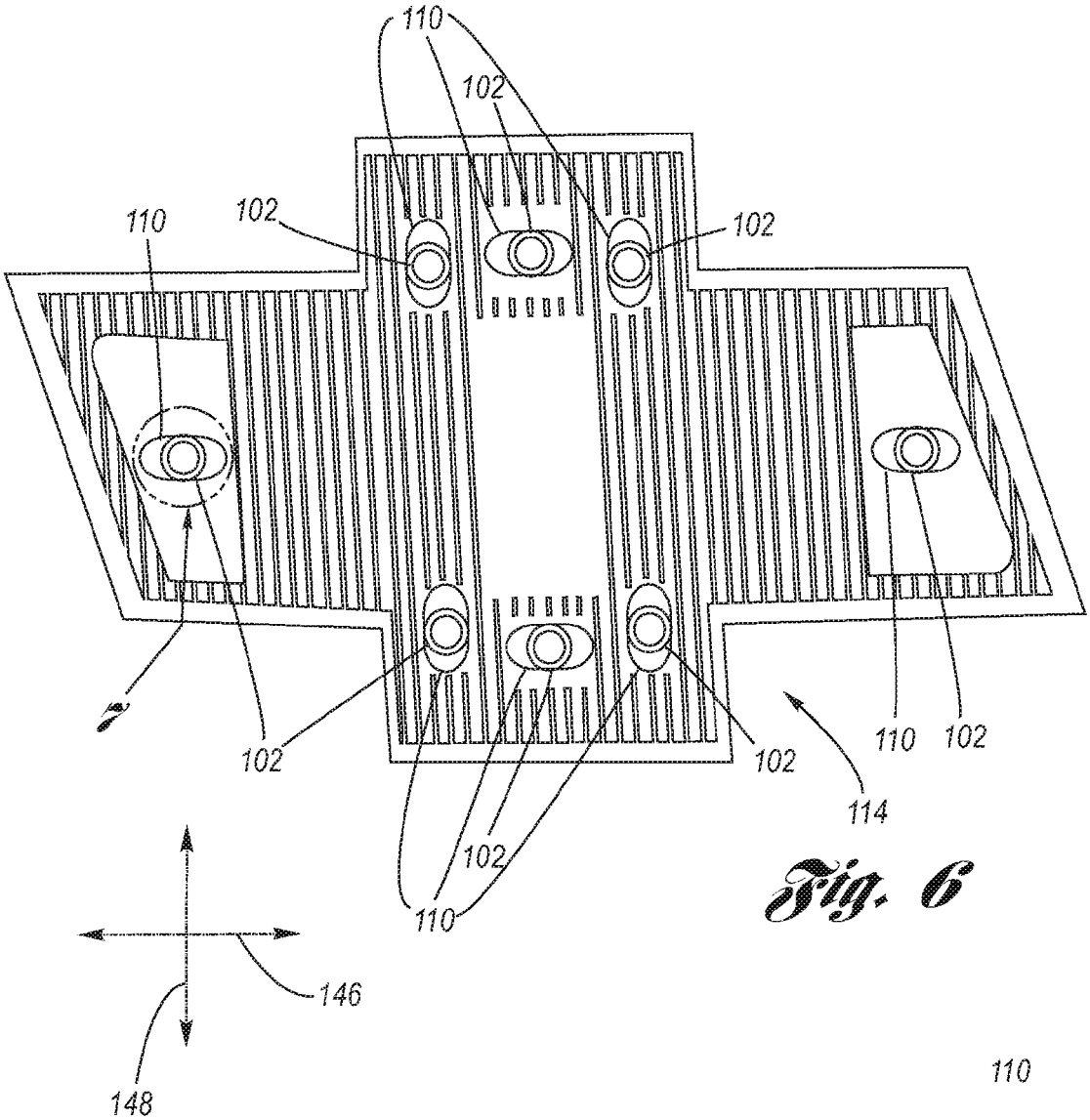
FIG. 6 is a rear plan view of the fully mated emblem lens and outer bezel, showing the elastic tube alignment features interfaced with the aperture alignment features in accordance with the present invention.

As mentioned above, the apertures 110 are elongated along the elongation axis 142. In that the elastic deformation as between the elastic tubes 102 and the apertures 110 occurs at the aperture cross-section 132 and not at the aperture elongation 140 (which is longer than the tube diameter 130), localized directional alignment of the emblem lens and the outer bezel is provided. For example, as best shown at FIG. 6, four of the elastic tubes 102 elastically deform with respect to apertures 110 having an elongation axis parallel to a cross-car axis 146, and four of the elastic tubes 102 elastically deform with respect to apertures 110 having an elongation axis parallel to an up-down axis 148. The orientation of the elongation axis is predetermined to provide elastic deformation due to compressive force applied by the aperture to the elastic tube is in a direction perpendicular to the elongation axis which provides assurance of a Class A fit at the visible joint 124.

During the mating of the emblem lens 106 to the outer bezel 114, each elastic tube 102 respectively engages its corresponding aperture 110, wherein as the elastic tubes pass into the apertures, any manufacturing variance in terms of position and size thereof is accommodated by elastic deformation on average of the plurality of elastic tubes and apertures. This elastic averaging across the plurality of elastic tubes and apertures 102, 110 provides a precise alignment as between the emblem lens and the outer bezel 106, 114 when they are at the fully mated state relative to each other.

According to the present invention, the elastic averaging provides elastic deformation of the interface between the plurality of geometrically distributed elastic tube alignment features 102 and the aperture alignment features 110, wherein the average deformation provides a precise alignment, the manufacturing variance being minimized to X', defined by $X'=X/\sqrt{N}$, where X is the manufacturing variance of the elastic tube and aperture alignment features and N is the number thereof.

Further according to the present invention, it is possible, but not required, for the aperture alignment members 110 to be also elastically deformable by elastic expansion of the aperture sidewall, which deformation is also preferably reversible.

Referring now to FIGS. 2 through 7, operation of the elastic tube alignment system 100 according to the present invention will be detailed.

Figure 5:
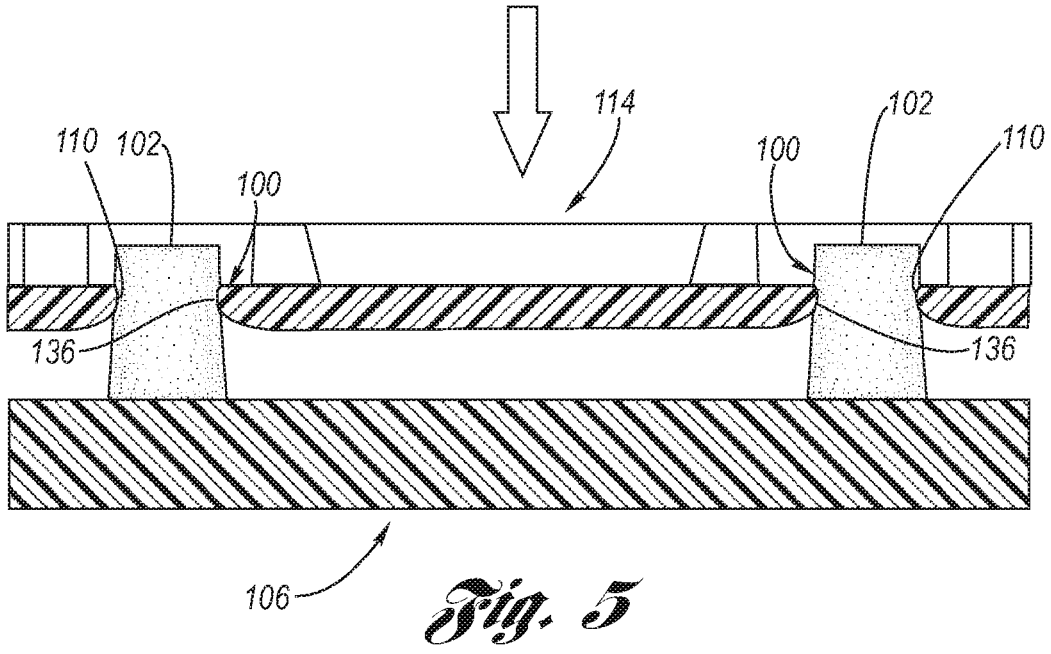
FIG. 5 is a sectional view as in FIG. 4, wherein now the emblem bezel is at an intermediate stage of mating with respect to the outer bezel in accordance with the present invention.

As seen at FIG. 4, the emblem lens and the outer bezel 106, 114 are brought into close proximity with near alignment. Referring next to FIG. 5, as the emblem lens and the outer bezel 106, 114 are mated together, the initial contact therebetween is via the plurality of geometrically spaced apart elastic tubes 102 passing into their one-to-one corresponding apertures 110, whereduring the emblem lens and the outer bezel align to one another. The alignment is precise at FIGS. 2, 3 and 6, wherein the emblem lens and the outer bezel 106, 114 are now at the fully mated state. The alignment is precise because the (largest size) diameter of elastic tubes relative to the aperture cross-section of the apertures results in elastic deformation, and this elastic deformation is elastic averaged over the plurality of geometrically distributed elastic tubes. When an affixment modality is implemented, such as for example two sided tape or emblem adhesive, etc., the precise alignment becomes manifest, and the visible joint 124 between the emblem lens and the outer bezel is a perfect Class A finish.

It will be understood from the foregoing description, several notable aspects of the present invention. The present invention: 1) eliminates the manufacturing variation associated with the clearances needed for a 2-way and 4-way locating schemes of the prior art; 2) reduces the manufacturing variation by elastically averaging the positional variation; 3) eliminates the float between the emblem lens and the outer bezel as is present in the perimeter to pocket sidewall float in the prior art; 4) provides an over constrained condition that reduces the positional variation by averaging out each locating features variation, and additionally stiffens the joint reducing the number of needed fasteners; 5) provides more precise location of emblem lens and the outer bezel; and, 6) provides a stiffened assembly of the mated emblem lens and the outer bezel with elimination of rattle between the components in elastic deformation with respect to each other.

To those skilled in the art to which this invention appertains, the above described preferred embodiment may be subject to change or modification. Such change or modification can be carried out without departing from the scope of the invention, which is intended to be limited only by the scope of the appended claims.

The invention claimed is:

1. An elastic tube alignment system for aligning an emblem lens with respect to an outer bezel, comprising:

an emblem lens having an emblem first side;

an outer bezel having a bezel first side;

a plurality of upstanding elastic tubes connected to said emblem first side;

a plurality of apertures formed in said outer bezel, each aperture having an aperture wall;

wherein said plurality of apertures are geometrically distributed in coordinated relationship to a geometrical distribution of said plurality of elastic tubes such that each elastic tube is receivable into a respective aperture;

wherein when each said elastic tube is received into its respective aperture an elastic deformation occurs at an interface between the tube wall and the aperture wall, wherein said elastic deformation is responsive to each said tube wall having a diameter larger than a cross-section of its respective aperture; and wherein said elastic deformation is elastic averaged over said plurality of elastic tubes such that the first component is precisely located relative to the second component.

2. The elastic tube alignment system of claim 1, wherein each said tube wall defines a hollow cylinder.

3. The elastic tube alignment system of claim 1, wherein said elastic deformation comprises resiliently reversible elastic deformation of each said tube wall.

4. The elastic tube alignment system of claim 3, wherein said elastic deformation further comprises resiliently elastic deformation of each said aperture wall.

5. The elastic tube alignment system of claim 3, wherein each said tube wall is tapered, wherein the taper provides a smallest diameter distally from the first surface.

6. The elastic tube alignment system of claim 5, wherein each said aperture has a beveled aperture wall at said cross-section.

7. The elastic tube alignment system of claim 6, wherein each said aperture is elongated in relation to said cross-section along an elongation axis.

8. The elastic tube alignment system of claim 7, wherein a joint is formed when said emblem lens is mated to said outer bezel, wherein said elongation axis of each said aperture is oriented parallel in relation to predetermined direction responsive to said joint, wherein said cross-section of said aperture is oriented generally perpendicular in relation to said elongation axis.

9. The elastic tube alignment system of claim 4, wherein each said aperture has a beveled aperture wall at said cross-section.

10. The elastic tube alignment system of claim 1, wherein each said aperture is elongated in relation to said cross-section along an elongation axis.

11. The elastic tube alignment system of claim 10, wherein a joint is formed when said emblem lens is mated to said outer bezel, wherein said elongation axis of each said aperture is oriented parallel in relation to predetermined direction responsive to said joint, wherein said cross-section of said aperture is oriented generally perpendicular in relation to said elongation axis.

12. The elastic tube alignment system of claim 4, wherein each said tube wall defines a hollow cylinder.

13. The elastic tube alignment system of claim 4, wherein said elastic deformation provides a stiffened assembly of said first and second components when said first and second components are mutually mated to each other.

14. A method for precisely aligning an emblem lens to an outer bezel during a mating operation, said method comprising the steps of:

providing an emblem lens having an emblem first side;

providing an outer bezel, wherein in said steps of providing, said first emblem side is provided with a plurality of upstanding elastic tubes and a plurality of apertures are formed in said outer bezel, wherein the plurality of apertures are geometrically distributed in coordinated relationship to a geometrical distribution of the plurality of elastic tubes such that each elastic tube is receivable into a respective aperture;

mating the emblem lens to the outer bezel, whereduring the emblem lens is aligned to the outer bezel by each said elastic tube being received into its respective aperture;

elastically deforming an interface between each elastic tube and its respective aperture; and elastic averaging the elastic deformation over the plurality of elastic tubes such that upon mating, a precise location of the emblem lens with respect to the outer bezel.

15. The method of claim 14, wherein said step of elastically deforming comprises resiliently reversible elastic deformation of each elastic tube.

16. The method of claim 15, wherein said step of mating forms a joint between said emblem lens and said outer bezel, wherein an elongation axis of each said aperture is oriented parallel in relation to predetermined direction responsive to said joint, and wherein said cross-section of said aperture is oriented generally perpendicular in relation to said elongation axis.

17. The method of claim 16, wherein in said steps of providing, a manufacturing variance of size and position of the elastic tubes and the apertures occurs, wherein the manufacturing variance has an average length of X, and wherein said step of elastic averaging provides a reduced manufacturing variance of length X', where $X'=X\sqrt{N}$, wherein N is the number of the elastic tubes.

* * * * *